US007265284B2

(12) United States Patent
Muir et al.

(10) Patent No.: US 7,265,284 B2
(45) Date of Patent: Sep. 4, 2007

(54) VIOLIN OR THE LIKE SHOULDER REST

(75) Inventors: Rod Muir, South Mountain (CA); Jason Busschaert, Ottawa (CA); Mark Edey, Ottawa (CA); Derek Kirkland, Chelsea (CA)

(73) Assignee: The Kun Shoulder Rest, Inc., Ottawa, Ontario (CA)

( * ) Notice: Subject to any disclaimer, the term of this patent is extended or adjusted under 35 U.S.C. 154(b) by 0 days.

(21) Appl. No.: 10/545,967

(22) PCT Filed: Dec. 23, 2003

(86) PCT No.: PCT/CA03/02023

§ 371 (c)(1),
(2), (4) Date: Jul. 20, 2006

(87) PCT Pub. No.: WO2004/077399

PCT Pub. Date: Sep. 10, 2004

(65) Prior Publication Data

US 2007/0044630 A1 Mar. 1, 2007

(30) Foreign Application Priority Data

Feb. 26, 2003 (CA) ..... 2419912

(51) Int. Cl.
*G10D 1/02* (2006.01)

(52) U.S. Cl. ..... 84/279

(58) Field of Classification Search ..... 84/278, 84/279, 280, 281
See application file for complete search history.

(56) References Cited

U.S. PATENT DOCUMENTS 3,631,754 A 1/1972 Kun
4,386,548 A 6/1983 Wolf
5,208,409 A 5/1993 Roulet
5,270,474 A 12/1993 Kun
5,275,078 A 1/1994 Wolf
5,419,226 A 5/1995 Kun
6,369,303 B1 * 4/2002 Hvezda ..... 84/278
6,756,531 B2 * 6/2004 Ruan ..... 84/278

FOREIGN PATENT DOCUMENTS

DE 3643225 7/1987
GB 2052828 1/1981

* cited by examiner

*Primary Examiner*—Kimberly Lockett
(74) *Attorney, Agent, or Firm*—Stevens, Davis, Miller & Mosher, LLP

(57) ABSTRACT

The distance between the clamps at opposed ends of a shoulder rest bridge adjustable in infinitely fine increments by utilizing a pressure plate which, in an engaged mode, presses a brake member made from an elastomer, particularly soft rubber, against the underside of the bridge body. The pressure plate is actuated by a pivotable latch having a lever and co-operating with a non-rotatable bearing member having a ramp surface complementary in the direction of incline and in pitch with the ramp surface of the pivotable latch. A supplementary camming mechanism provides, upon hand displacement of one of the clamps towards the other into engagement by both with the instrument, an additional motion of the one clamp toward the instrument thus increasing the clamping force holding the shoulder rest to an instrument.

16 Claims, 6 Drawing Sheets

VIOLIN OR THE LIKE SHOULDER REST

This application is a §371 National Stage Application of International Application No. PCT/CA2003/002023, filed on 23 Dec. 2003, claiming the priority of Canadian Patent Application No. 2,419,912 filed on 26 Feb. 2003.

The present invention relates to a shoulder rest for use with a violin or a violin-like instrument such as a viola. More specifically, the invention relates to the type of shoulder rest having a relatively rigid, elongated base or bridge and upright, usually fork-shaped clamping elements secured at each end of the bridge, As is known, in this type of shoulder rests, the distance between the clamping elements must be adjustable so the shoulder rest can match several sizes of the instrument.

It is known to provide a mechanism for adjusting the distance between the clamping elements where a row of openings is provided in a foot member of at least one of the clamping elements. A selected opening engages a pin projecting from the bridge. Alternatively, a screw, threaded into the bridge of the shoulder rest is engaged with a selected opening in the foot member. This results in a positive locking of the foot member and thus of the clamping element or elements in a number of locations along the bridge of the shoulder rest.

A typical example of adjustable shoulder rests of this type is described, for instance, in U.S. Pat. No. 5,419,226 (kun) issued May 30, 1995 or U.S. Pat. No. 3,631,754 (Kun), issued Jan. 4, 1972.

It is also known to provide a somewhat more complex adjustment mechanisms which allows an infinite rather than step-wise adjustment of the distance between the clamping forks. This group is described, for instance, in U.S. Pat. No. 5,275,078 (Wolf) issued Jan. 4, 1994, where a sleeve with a setscrew receives a sliding arm supporting one of the clamping elements. On adjustment of the distance. The setscrew is tightened to secure the instrument clamping distance. A similar adjustment mechanism is disclosed in U.S. Pat. No. 4,386,548 (Wolf) issued Jun. 7, 1983.

It is a common disadvantage of both above types that the adjustment takes place prior to the attachment of the rest to the instrument. The attachment of a pre-adjusted shoulder rest is then effected either by forcibly sliding the clamping forks onto the rim of the bottom of the instrument, or the clamps are spread away from each other and then placed over the rim in a direction perpendicular to the bottom of the instrument. At the same setup, the clamping force is different depending on the actual size of the instrument. It may be too strong in case of a larger body of an instrument, subjecting the parts of the shoulder rest to undue stress. In an opposite extreme of the instrument size still matched by the same instant adjustment the clamping force may be too low potentially causing inadvertent release of the shoulder rest from the instrument with the resulting damage to the body of the instrument, not to mention the discomfort caused to the player.

It is an object of the present invention to provide a shoulder rest with an infinitely finely adjustable mechanism which would not only secure convenient attachment to the instrument but also a uniform clamping pressure regardless of the instant adjusted distance between the clamping forks. It is another object of the present invention to provide a shoulder rest, in which the final clamping force can be generated at the point when the opposed clamping forks are both already in engagement with the rim of the bottom of the instrument.

A preferred embodiment of the invention will now be described with reference to the accompanying drawings, wherein FIG. 1 is an exploded perspective view of a shoulder rest showing the components of the shoulder rest according to the present invention;

Figure 1:
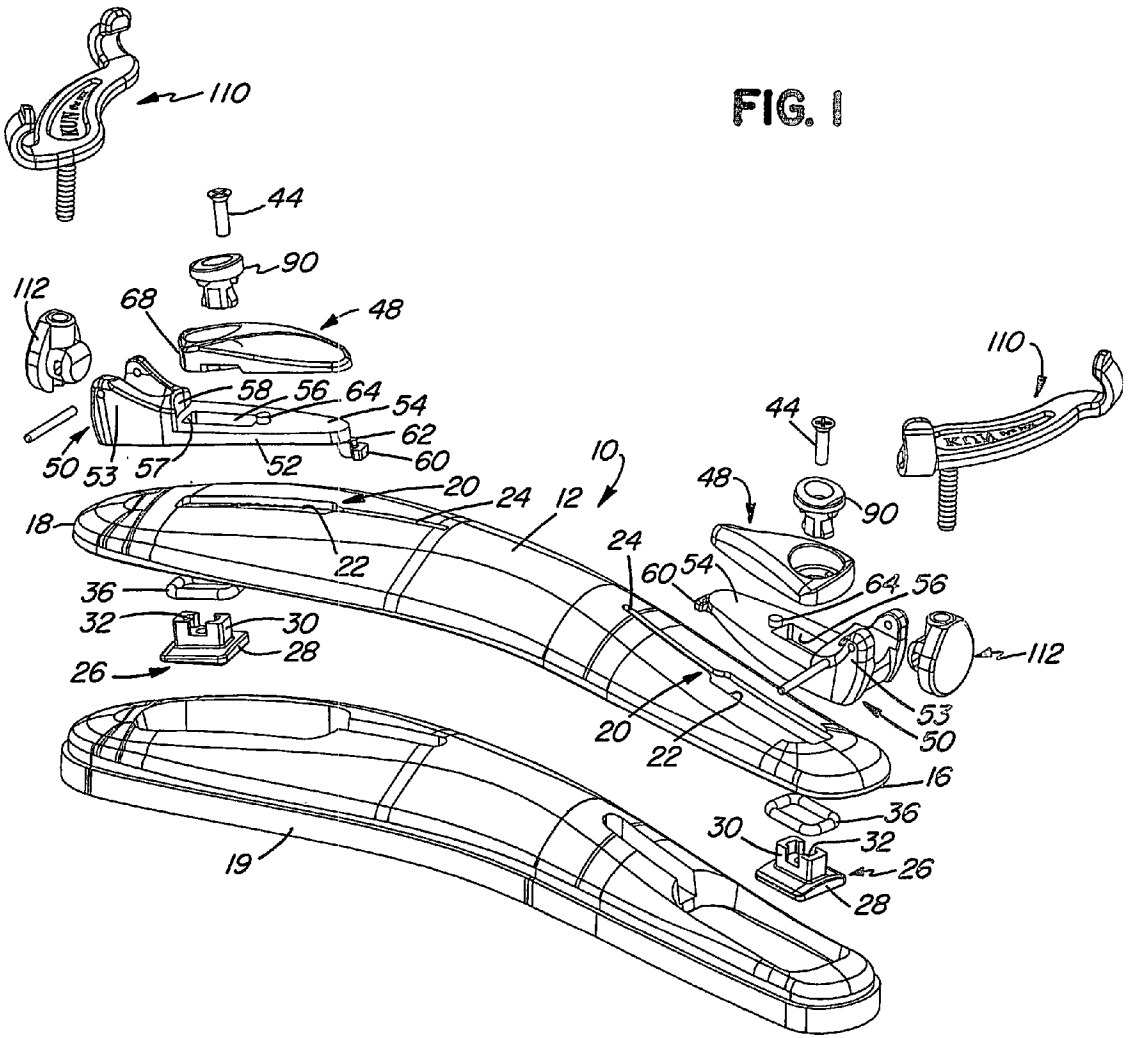

Reference number 10 designates the body of the bridge of the shoulder rest. The body is made of a rigid material such as carbon fibre reinforced plastic material. It has a convexly rounded top 12 and a concavely rounded underside 14, a first end 16 and a second end 18. As is well known, the body 10 is provided with a soft padding, for instance, a foam pad 19 adhesively secured to the underside 13 of the body 10.

Adjacent to the first end 16, the body 10 is provided with a longitudinally extending slot 20 which has a wide portion 22 near the first end 16 and a coextensive narrow portion 24 remote from the first end 16. Disposed below the wide portion 22 is a pressure plate 26 which has a rectangular base portion 28 and an upwardly projecting, integrally formed boss 30 having the shape of a hollow rectangular prism defining a cavity 32 open on top. An elastomeric rectangular O-ring 36, preferably made of soft rubber is engaged, at its bottom end, by a ledge formed by the base portion 28 around the boss 30. At the centre of the base portion 28, a nut 38 (FIG. 7 or 9) is fixedly molded into the lower portion of the pressure plate 26. Disposed concentrically with the nut 38 is a bore 40 which permits free passage of a screw 44.

In a locked engagement, shown in FIG. 2 or 7, a latching mechanism described later causes the ledge of the base portion 28 to press the O-ring 36 against a roughened surface portion 46 (FIG. 2) provided in the underside 14 of the body 10 around the wide portion 22 of the slot 20. Accordingly, in the latched state, the pressure plate 26 is fixedly secured to the body 10.

Figure 2:
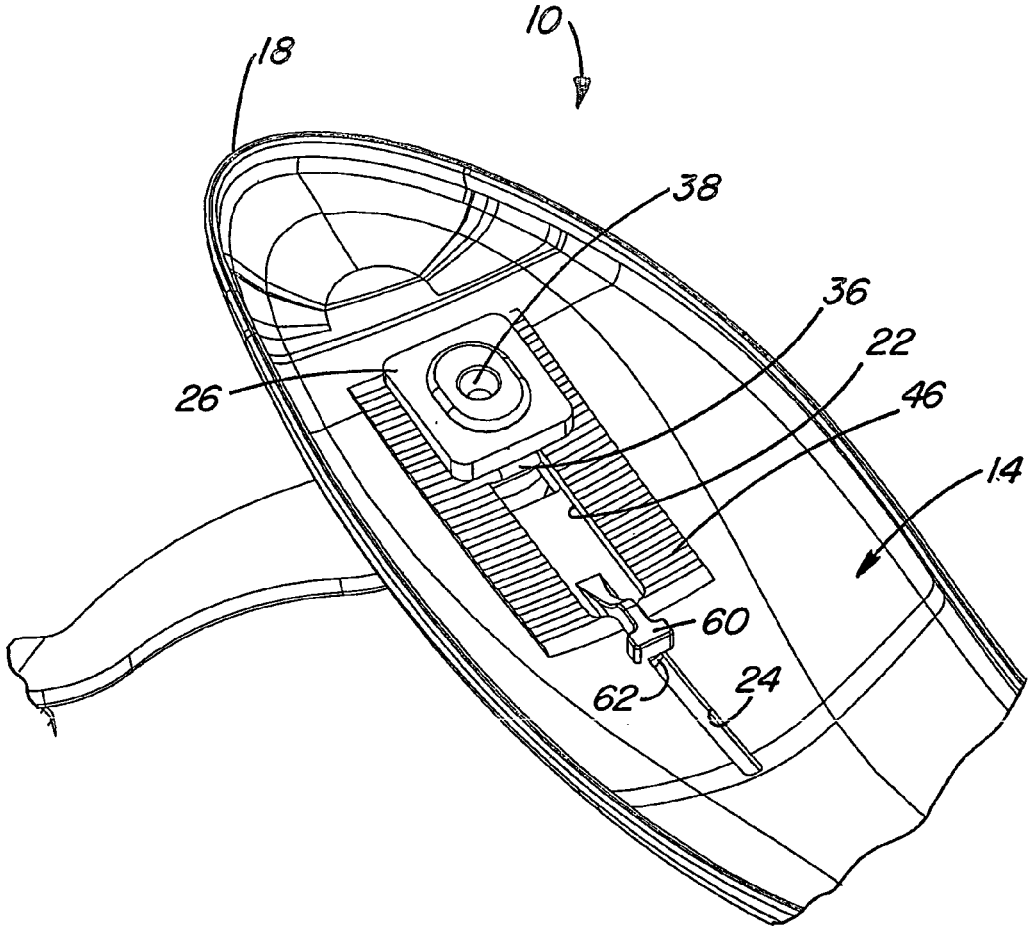
FIG. 2 is a partial bottom view of the shoulder rest showing the distance adjustment mechanism in a latched state.
Figure 3:
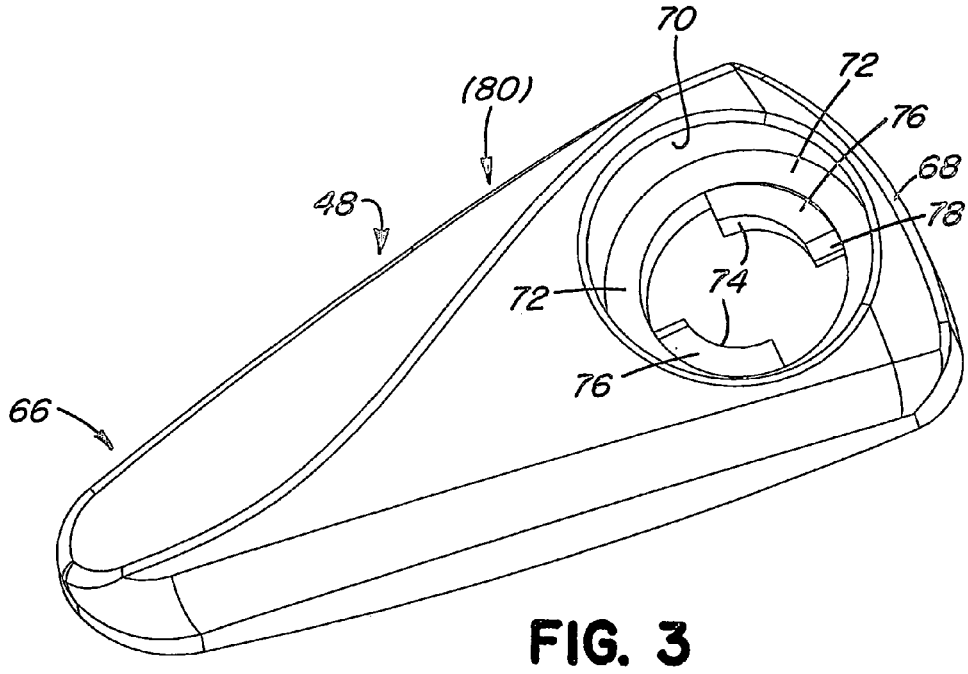
FIG. 3 is a top and one side perspective view of a latch of the present invention.

Reference is now briefly made to FIG. 3. It shows a latch 48. The latches 48 at each end 16, 18 of the body 10 are of a generally identical configuration and their corresponding parts are therefore referred to with the same reference numbers. The orientation of the latch in FIG. 2 corresponds to that of the latch 48 at the second end 18 of the body 10. In an assembled state, the latch 48 is selectively pivotal and slidable relative to the associated carrier 50 as will be described.

The carrier 50 is best shown in FIG. 1. The drawing shows that there are two carriers 50 and their associated parts. It can be observed that there is a minor difference in the shape of the two carriers. The shape of the underside, of each carrier 50 follows the configuration of the surface 12 of the body 10 at the respective end 16, 18. Thus, the underside of the carrier 50 at the end 16 is slightly convex, while that of the opposed carrier at the end 18 is very slightly concave. These differences have no effect on the operation and general configuration of the carrier 50.

The carrier 50 has a base (also referred to as "a foot portion") 52 with a flat top surface 54, and an upright portion 53. There is an elongated rectangular slot 56 provided in the surface portion 54 and passing through the foot portion 52. A rear end 57 of the slot 56 is proximate to the respective end 16, 18 of the bridge. At the rear end of the surface portion 54, a concavely curved guide surface 58 projects upwards from the flat surface portion 54. At the opposed, front end of the surface portion 54, a guide nose 60 extends downwardly and forwards from the front end of the base 52. The nose is wider than the width of the associated narrow portion 24 of the slot 20.

A short, upwards projecting guide pin 62 is compatible with the narrow portion 24 of the slot 20 in the body 10, for a sliding movement therein. Accordingly, the nose 60 and the pin 62 co-operate to allow a guided sliding movement of the carrier 50 along the body 10 but at the same time maintain the underside of the carrier 50 in a sliding contact with the surface 12 of the body 10, thus constantly maintaining the upright portion 53 and the elements mounted thereon in a generally upright position. A follower pin 64 projects from the top surface 54 near the front end of the slot 56.

Turning now back to FIG. 3, the latch 48 has a forwards extending lever portion 66. (presenting an embodiment of what is also referred to as "a brake lever") and a rear, convexly rounded end surface 68. The radius of the end surface 68 corresponds to that of the concave guide surface 58 (FIG. 1). A circular opening 70 is provided in proximity to the rounded surface 68. An annular, continuous, radially inwardly directed ledge 72 extends circumferentially about the inner wall of the opening 70. Further projecting radially inwards from the annular ledge 72 is a pair of opposed arcuate ramp members 74 of which only one is fully visible in FIG. 3. Each ramp member 74 defines a first ramp 76 which is inclined in a counter-clock-wise direction. A steep chamfer 78 is shown at the clock-wise end of the ramp member 74. There is a cutout 80 at the bottom part of the side of the latch 48.

Figure 4:
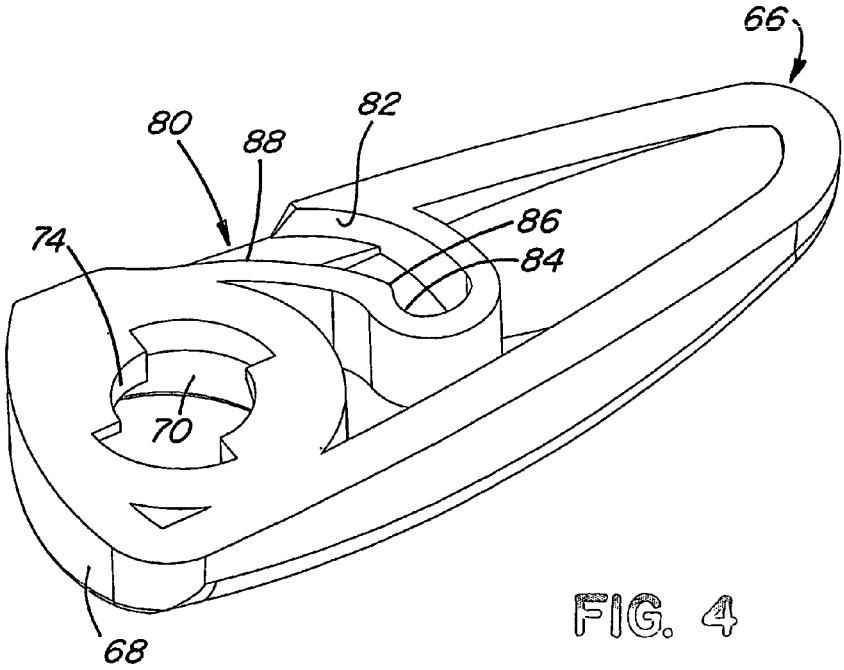
FIG. 4 is a bottom and the other side perspective view of the latch.

The cutout 80 is better visible in FIG. 4, showing the underside of the latch 48. The depth of the cutout 80 is intended to accommodate the axial height of the follower pin 64 (FIG. 1). The cutout 80 presents an entry into a camming system which is comprised of a front, concavely arcuate section 82 extending from the side of the cutout 80 adjacent to the lever portion 66. The concavely arcuate section 82 merges into a generally semicircular pocket portion 84 the radius of which corresponds to the radius of the follower pin 64. The pocket portion 84 then continues to merge with a convexly rounded step portion 86 where the concavely curved part 82, 84 of the camming system changes to a convexly arcuate first camming surface 88 extending from the step portion 86 to the cutout 80. The pocket portion 84, step portion 86 and the camming surface 88 combine with the follower pin 64 to present an embodiment of "clamping force generating means."

Figure 5:
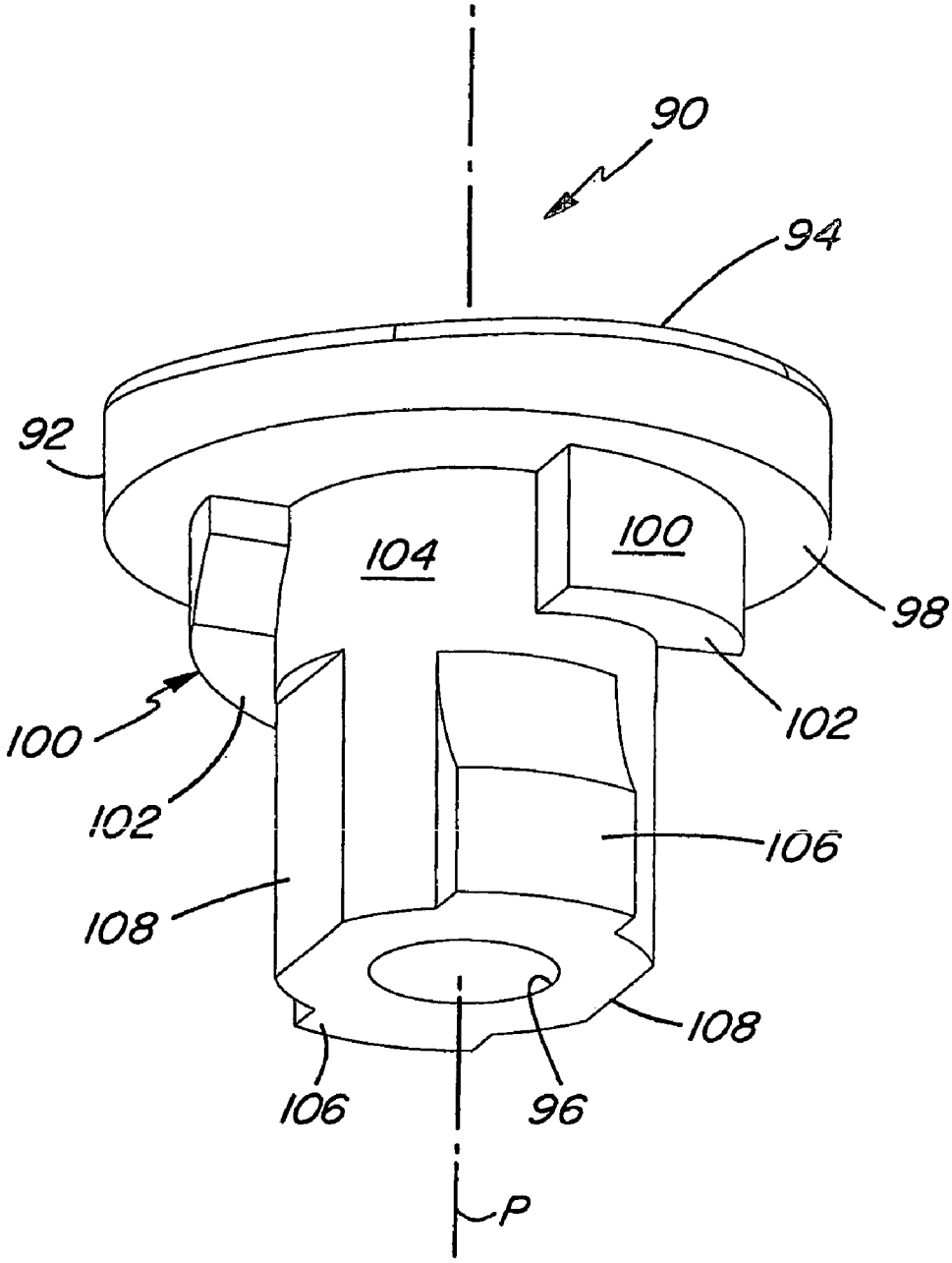
FIG. 5 is a bottom perspective view of a bearing member of the inventive mechanism.

The latch 48 is arranged for pivoting about the pivot axis P of the bearing member 90 shown in FIG. 5. The bearing member has a cylindric section 92 at an upper end. The diameter of the cylindric section 92 corresponds to the diameter of the opening 70 in the latch (FIG. 3) for pivotal movement therein about the axis P. The upper surface 94 of the member 90 is slightly convexly curved to smoothly blend with the surface of the latch 48. Disposed centrally of the member 90 is a bore 96 which is configured to allow passage of the countersunk screw 44. The underside 98 of the cylindric section 92 is annular and generally flat. In an assembled state, its radially outer portion is adapted to be closely axially spaced from the ledge 72 of the latch 48, inside the opening 70. Two opposed ramp projections 100 extend from the underside 98. They are each provided with a ramp surface 102 which is inclined in a circumferential clock-wise direction as viewed in FIG. 5. The pitch and inclination of the ramp surface 102 is compatible with the pitch and inclination of the ramp 76 of the latch 48 for a constant sliding engagement between the two when the bearing member is disposed in the opening 70 of the latch 48. The ramp projections 100 and their ramp surfaces 102, together with the compatible ramps 76 of the latch 48 can also be generally referred to as first and second ramp means 74, 76, 100, 102. Also, the plate 26 and bearing member 90 combine to form an embodiment of what is generally referred to as "pressure applicator means." Furthermore, the bearing member 90 forms, with the latch 48, screw 44 and the top surface 54 and operative unit which is generally referred to as a "braking force actuating means."

The lower end of the cylindric body 104 is integrally formed with radially extending opposed locking projections 106 which are adapted to lockingly engage the rectangular cavity 32 in the boss 30 of the pressure plate 26. The opposed flat surfaces 108 and the sides of the boss 30 bring the cylindric body 104 to a configuration slidingly compatible with the slots 22 and 56. The boss 30 and the surfaces 108 therefore combine to define an embodiment of what is generally, referred to as "rear guide means" since they co-operate with the nose 60 and pin 62 at the front end of the base 50 or foot portion 52 to slidingly guide the the carrier 50 along the slot 22.

Figure 6:
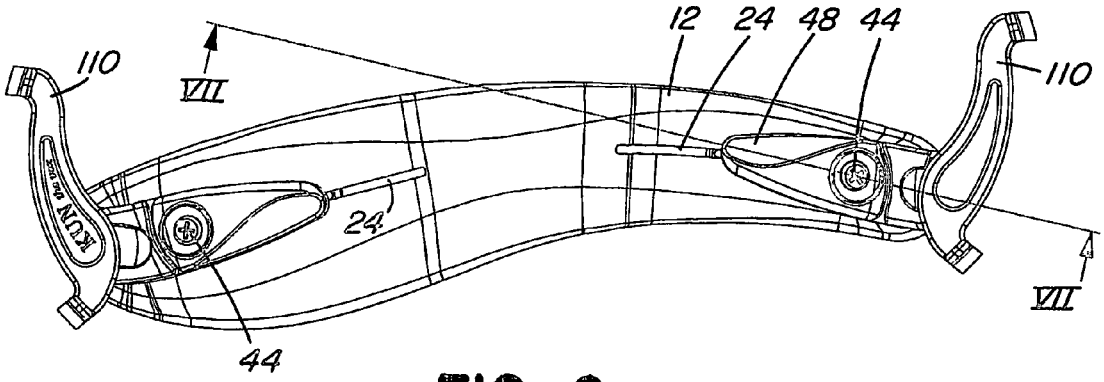
FIG. 6 is a simplified top plan view of the inventive shoulder rest showing the latch in a latched state.
Figure 7:
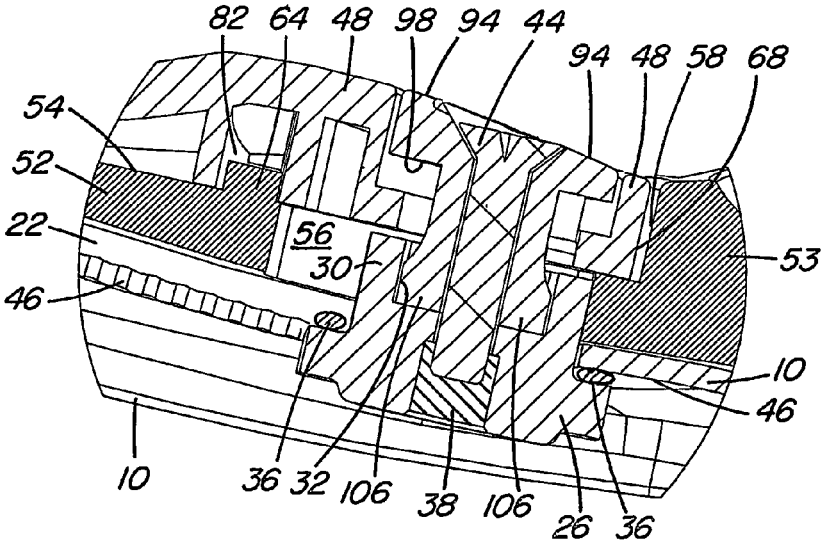
FIG. 7 is an enlarged part of section VII-VII of FIG. 6.

Thus, when the adjusting mechanism is in a locked or closed state indicated in FIG. 2 or FIGS. 6 and 7, the pressure plate 26 is fixed by virtue of the O-ring 36 and the slots 22 and 56 to the body 10 of the bridge and cannot turn or slide relative to the body. The screw 44 passing through the bore 96 in the bearing member 90 into the nut 38 provides a fixed securement of the bearing member 90 to the pressure plate 26 and therefore is also non-movable relative to the body 10 of the bridge. The fixed securement of these elements at this stage is achieved by a raised position between the interengaged surfaces of the ramps 76 of the latch 48 and 102 of the ramp members 74 which results in a firm compression of the O-ring 36. At this stage, the lever portion 66 of the latch is disposed longitudinally of the body 10 of the bridge. It should also be noted that, at this stage, the end surface 68 of the latch 48 is virtually coincident with the concave guide surface 58. The follower pin 64 is now disposed in the pocket portion 84 of the camming system in the underside of the latch 48.

The clamping fork 110, received in a fork pivot 112 is now in a clamping stated, blocked from displacement longitudinally of the body of the bridge 10.

Figure 8:
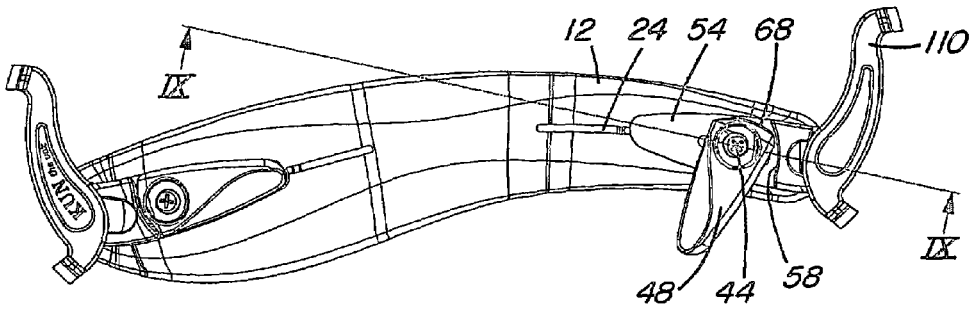
FIG. 8 is a simplified and partial top plan view similar to that of FIG. 6 but showing the latch in a released state.

Assuming now that it is desired to adjust the position of the clamping fork longitudinally of the bridge 10, the latch 48 is disengaged by turning the lever portion 66 as shown in FIG. 6 counter-clockwise, to an open position as shown in FIG. 8. The turning takes place about the axis P, coincident with the centre of the opening 70 which guides the pivoting movement of the latch 48.

Proceeding from the fully closed detail of FIGS. 6 and 7, the counter-clock-wise turning of the lever portion 66 results in dual function, one at the follower pin 64 and the concave guide surface 58, the other at the bearing member 90.

At the underside of the latch 48, the follower 64 reaches the top of the step 86. Eventually, the concavely arcuate camming surface 82 engages the follower 64 and, as the turning of the lever portion 66 continues, the surface 82 causes the movement of the follower and thus of the carrier 50, relative to the latch 48, toward the adjacent end 16 or 18 of the body. The action of the camming surface and the follower 64 is couplemented by the displacement forced by engagement of a corner between the surface 68 and the rest of the latch 48 with the concave surface 58 as shown in. FIG. 8. Note that a part of the follower 64 is now outside of the contour of the latch 48.

Virtually simultaneously with the action at the follower 64, the turning of the lever 66 releases the axially upward pressure at the bearing member 90 and the pressure plate 26 fixedly secured to it. This releases the engagement of the O-ring 36 with the roughened surface 46 at the underside of the body 10.

With the O-ring 36 now disengaged from the surface 46, the entire carrier 50 is no longer fixed to the body 10 and is free to move along the associated slot 22.

Figure 9:
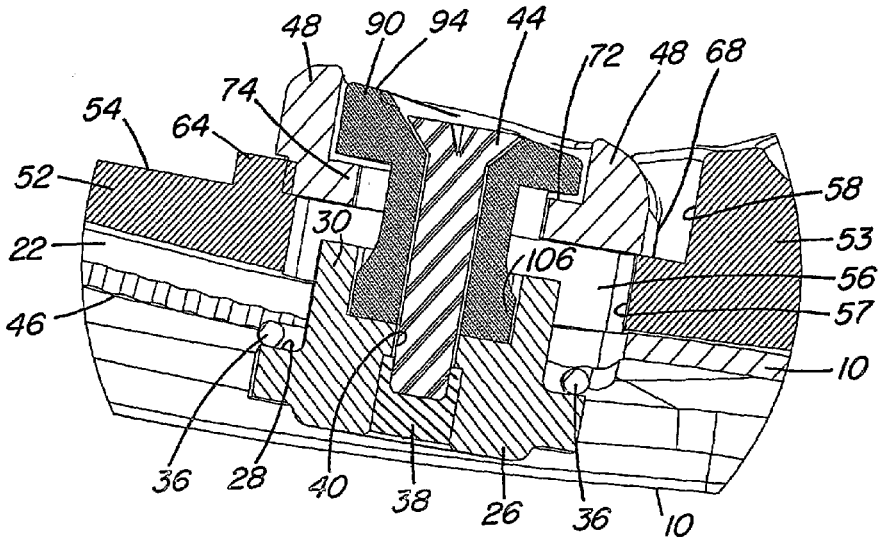
FIG. 9 is an enlarged part of section IX-IX of FIG. 8.

At the disengaged, open position, the end surface 68 of the latch 48 is remote from its counter-surface 58 provided in the carrier 50 and the boss 30 is remote from the rear end 57 of the slot 56 (FIG. 9)

When the shoulder rest is to be attached to the instrument, one of the two carriers 50 would typically be in the closed mode of FIGS. 7 and 6 i.e., fixedly secured to the body 10 as described, while the other would be in a released mode as shown in FIGS. 8 and 9.

The clamping fork 110 of the carrier 50 fixed to the body 10 is engaged with one side edge of the bottom of the instrument. The released carrier is then slid by hand toward the fixed carrier until its fork is firmly engaged with the side edge at a location opposite to that of the fixed carrier 50. Subsequently, the handle 66 is rotated clock-wise from the position of FIG. 8 to that of FIG. 6.

The clock-wise rotation of the handle again provides two effects. First, the ramps 76 engaging the ramp surfaces 102 raise the bearing member 90 axially upwards. Since the bearing member is fixedly secured to the pressure plate 26, the lifting motion re-engages the O-ring 36 with the underside of the body 10 at the roughened surface 46.

While the process of engaging the O-ring with the body is in progress, the camming, convexly arcuate portion 88 develops, at the follower pin 64 and thus the carrier 50 and the associated fork 110, an additional motion of the carrier 50 towards the opposite end of the body 10, to more firmly engage the associated fork to the instrument. This also results in the re-closing of the gap between the end surface 68 and its counter surface 58. Eventually, the pin 64 reaches the nested position in the pocket portion 84, whereby the lever 66 is maintained in a longitudinally aligned position shown in FIG. 6.

The advantage of the arrangement just described is in that it permits a clamping engagement of the instrument between the forks 110 to become increased upon closing of the lever 66 to increase the strength of the securement of the shoulder rest to the bridge body 10 while always providing a uniform increase of the clamping force. The shoulder rest therefore does not have to be subjected to a forced spreading apart of the clamping forks while the shoulder rest is attached or is being attached to the instrument.

Those skilled in the art will appreciate that other embodiments of the present invention may exist which differ from the embodiment described. For instance, the embodiment shown is provided with two adjustable carriers 50 while only one adjustable carrier and one carrier integrally molded with the body of the bridge and thus non-adjustable can also be used. The use of the elastomeric O-ring as a resilient motion blocking element as described is presently preferred. However, it is readily conceivable that other configurations, for instance a rectangular cross-section of the rectangular member 36 or even a pair of elastomeric strips each integrally molded on or otherwise fixed one to each longer side of the pressure plate 26 would perform a generally equivalent function. It is preferred that the camming mechanism providing the additional clamping force be as described. However, it will be appreciated that a mechanical equivalent of the mechanism may be provided where the camming surfaces would be provided in the carriers 50 and the camming pin would be fixed to the latch 48.

These and many other modifications may depart from the embodiment described without departing from the scope of the present invention as set forth in the accompanying claims.

The invention claimed is:

1. A shoulder rest for use with a violin or the like instrument having a shoulder engaging bridge, said bridge including (a) an elongated body having a top surface, an underside, a first end, a second end and a cushion portion secured to said underside;

(b) a pair of generally fork-shaped clamping members disposed one at each end of said body, for engagement with an associated instrument;

(c) a generally L-shaped carrier having a foot portion and an upright portion (53);

(d) one of said clamping members being mounted on said upright portion;

(e) said foot portion being coincident with said top surface near said first end and being slidable longitudinally of the body;

(f) carrier foot guide means including:

(i) a slot, extending longitudinally of the body;

(ii) a first guide member proximate to a front end of said foot portion and adapted to sliding guide said front end along the slot but preventing the displacement of said front end in a direction from said underside to said top surface;

(iii) rear guide means disposed at a location distal from the front end of said foot portion and adapted to slidingly guide the foot portion along the slot;

(g) pressure applicator means including a pressure plate turned towards the underside of the body and secured to the body at said location distal from the front end of said foot portion;

(h) elastomeric brake pad means disposed between said pressure plate and the underside of the body, whereby, on raising the pressure applicator means, the brake pad means is compressed between the pressure plate and the underside;

(i) braking force actuating means disposed at said top of the bridge and operatively associated with the pressure applicator means and with the carrier and adapted to selectively displace said plate toward, or away from, said underside to engage said elastomeric brake pad means with, or disengage same from, the underside thus fixing the carrier to, or releasing it for a free sliding movement along the body;

(j) clamping force generating means adapted to displace the carrier in a direction longitudinally away from said first end simultaneously with said fixing of same to the body.

2. The shoulder rest of claim 1, wherein the braking force actuating means comprises a brake lever pivotable relative to the foot portion about a pivot axis generally perpendicular to the latter, said lever being disposed at the top of the body and provided with circumferentially inclined first ramp means compatible in pitch and inclination with circumferentially inclined second ramp means fixedly secured to said pressure applicator means, whereby the first and second ramp means cooperate to raise the pressure applicator means along said axis or lower same, depending upon the direction of pivoting of the brake lever.

3. The shoulder rest of claim 2, wherein said clamping force generating means is a camming mechanism including a follower pin and a camming surface compatible with the pin, said camming surface and said pin being provided one in said latch, the other in said foot portion.

4. The shoulder rest of claim 2, wherein said clamping force generating means is a camming mechanism including a follower pin fixedly secured to the carrier and compatible with a first camming surface and a second camming surface, both provided in the brake lever and adapted to displace the carrier longitudinally of the body in a direction dependent on the sense of pivoting of the brake lever, and virtually simultaneously with the displacement of the pressure applicator means along said pivot axis.

5. The shoulder rest of claim 3, wherein said camming mechanism is configured to urge the follower pin and thus the carrier in a direction away from the first end to the second end only when the pressure applicator means is in a raised position, brakingly engaging the brake pad means with the underside.

6. The shoulder rest of claim 5, wherein said camming mechanism is configured to urge the follower pin and thus the carrier in a direction to the first end virtually simultaneously with disengagement of the brake pad means from the underside.

7. The shoulder rest of claim 4, wherein the first and second camming surfaces adjoin each other at a pocket portion compatible with the associated follower pin to releasably retain the latch in a closed position, with the shoulder rest applied to the instrument.

8. The shoulder rest of claim 1, wherein said pad means is a rubber O-ring having a generally rectangular configuration.

9. A shoulder rest for use with a violin or the like instrument having a shoulder engaging bridge, said bridge including:

(a) an elongated body having a top surface, an underside, a first end, a second end and a cushion portion secured to said underside;

(b) a pair of generally fork-shaped clamping members disposed one at each end of said body, for engagement with an associated instrument;

(c) a pair of generally L-shaped carriers each having a foot portion and an upright portion;

(d) one of each clamping members being mounted on each of said upright portions;

(e) each said foot portion being coincident with said top surface near the respective end and being slidable longitudinally of the body; each carrier being operatively associated with a carrier foot guide means including:

(i) a slot in said body, extending longitudinally of the body;

(ii) a first guide member proximate to a front end of the respective foot portion and adapted to slidingly guide the front end along the slot but preventing the displacement of said front end in a direction from said underside to said top surface;

(iii) rear guide means disposed at a location distal from the front end of the respective foot portion and adapted to slidingly guide the foot portion along the slot;

(f) pressure applicator means at each end of the body, including each a pressure plate turned towards the underside of the body and secured to the respective body at said location distal from the front end of the respective foot portion;

(g) elastomeric brake pad means disposed between each pressure applicator means and the underside of the body, whereby, on raising the associated pressure applicator means towards the underside, the associated brake pad means is compressed between the associated pressure applicator means and the underside;

(h) braking force actuating means including a latch disposed at each end of said top of the bridge and secured to the respective pressure applicator means and to the carrier and adapted to selectively displace the plate toward, or away from, said underside to engage the associated elastomeric brake pad means with, or disengage same from, the underside thus fixing the associated carrier to, or releasing it for a free sliding movement along the body;

(i) clamping force generating means adapted to displace each carrier in a direction longitudinally away from the respective end simultaneously with said fixing of the respective carrier to the body.

10. The shoulder rest of claim 9, wherein each braking force actuating means comprises a latch having brake lever pivotable relative to the associated foot portion about a pivot axis generally perpendicular to the latter, each said brake lever being disposed at the top of the body and provided with circumferentially inclined first ramp means compatible in pitch and inclination with circumferentially inclined second ramp means fixedly secured to the associated pressure applicator means, whereby each first and second ramp means cooperate to raise the associated pressure applicator means along said axis or lower same, depending upon the direction of pivoting of the brake lever.

11. The shoulder rest of claim 10, wherein each said clamping force generating means is a camming mechanism including a follower pin and a camming surface compatible with the pin, said camming surface and said pin being provided one in the associated latch, the other in the associated foot portion.

12. The shoulder rest of claim 10, wherein each said clamping force generating means is a camming mechanism including a follower pin fixedly secured to the associated carrier and compatible with a first camming surface and the respective second camming surface provided in the associated brake lever and adapted to displace the associated carrier longitudinally of the body in a direction dependent on the sense of pivoting of the brake lever, and virtually simultaneously with the displacement of the pressure applicator means along said pivot axis.

13. The shoulder rest of claim 11, wherein each camming mechanism is configured to urge the associated follower pin and thus the respective carrier in a direction away from the respective first or second end to an opposed end only when the pressure plate of the associated pressure applicator means is in a raised position, with the respective brake pad means braking engaged with the underside.

14. The shoulder rest of claim 13, wherein each camming mechanism is configured to urge the associated follower pin and thus the respective carrier in a direction from an adjacent end to a distant end of the respective body virtually simultaneously with disengagement of the associated brake pad means from the underside.

15. The shoulder rest of claim 12, wherein the respective first and second camming surfaces adjoin each other at a pocket portion compatible with the associated follower pin to releasably retain the associated latch in a closed position, with the shoulder rest applied to the instrument.

16. The shoulder rest of claim 9, wherein each pad means is a rubber O-ring having a generally rectangular configuration.

* * * * *